US008540295B2

(12) United States Patent
Babinchak

(10) Patent No.: US 8,540,295 B2
(45) Date of Patent: Sep. 24, 2013

(54) SLING WITH PROTECTIVE COVERING

(75) Inventor: Gregory Babinchak, Elizabethtown, PA (US)

(73) Assignee: Lift-All Company, Inc., Landisville, PA (US)

( * ) Notice: Subject to any disclaimer, the term of this patent is extended or adjusted under 35 U.S.C. 154(b) by 166 days.

(21) Appl. No.: 12/939,197

(22) Filed: Nov. 4, 2010

(65) Prior Publication Data

US 2012/0112482 A1 May 10, 2012

(51) Int. Cl.
*B66C 1/12* (2006.01)

(52) U.S. Cl.
USPC ..... 294/74

(58) Field of Classification Search
USPC ..... 294/74
See application file for complete search history.

(56) References Cited

U.S. PATENT DOCUMENTS

| | | | | |
|---|---|---|---|---|
| 3,317,233 | A * | 5/1967 | Black Boyd C | 294/74 |
| 3,845,633 | A * | 11/1974 | Hammond | 405/211 |
| 4,052,095 | A | 10/1977 | Johnson | |
| 4,124,244 | A * | 11/1978 | Bryant | 294/74 |
| 4,200,325 | A | 4/1980 | Johnson | |
| 4,243,118 | A | 1/1981 | Landry | |
| 6,422,624 | B1 | 7/2002 | Kauffman et al. | |
| 6,481,457 | B2 | 11/2002 | Hayes et al. | |
| 6,729,263 | B2 | 5/2004 | Miale et al. | |
| 7,240,475 | B2 | 7/2007 | Smeets et al. | |
| 7,475,926 | B2 | 1/2009 | Summars | |
| 7,628,435 | B1 * | 12/2009 | Golz | 294/74 |
| 7,658,423 | B1 | 2/2010 | Carmichael | |
| 7,661,737 | B2 | 2/2010 | St. Germain | |
| 7,669,904 | B1 | 3/2010 | Carmichael | |
| 2005/0005875 | A1 | 1/2005 | Suggs | |
| 2006/0261617 | A1 | 11/2006 | St. Germain | |
| 2009/0108603 | A1 | 4/2009 | St. Germain | |
| 2011/0298231 | A1 * | 12/2011 | Dohse et al. | 294/74 |

FOREIGN PATENT DOCUMENTS

| | | | |
|---|---|---|---|
| EP | 0594161 | A1 | 10/1993 |
| EP | 1899255 | B1 | 3/2008 |
| WO | 2006127489 | A1 | 11/2006 |
| WO | 2009058301 | A1 | 5/2009 |

OTHER PUBLICATIONS

"Tuflex Roundslings", LiftAll Catalog, pp. 42-54, as obtained May 2010.

* cited by examiner

*Primary Examiner* — Saul Rodriguez
*Assistant Examiner* — Gabriela Puig
(74) *Attorney, Agent, or Firm* — McNees Wallace & Nurick LLC

(57) ABSTRACT

A synthetic roundsling which has an endless load-bearing core with a plurality of loops of synthetic fibers for use in harsh environments. A tubular cover is provided for loosely containing the load-bearing core so that the fibers in the core are movable relative to each other and to the cover. The cover is waterproof to prevent the core from absorbing liquid. The core is prevented from increasing in weight and decreasing in flexibility due to liquid being absorbed by the core, thereby insuring that the roundsling will stay light and flexible even in harsh environmental conditions. A second, outer cover may provide additional protection to the core to protect the core from physical damage.

17 Claims, 3 Drawing Sheets

SLING WITH PROTECTIVE COVERING

FIELD OF THE INVENTION

The present embodiment is directed to industrial slings used in heavy load handling and control applications. In particular, the embodiment is directed to synthetic slings which maintain their lightweight and flexible characteristics even in harsh environments.

BACKGROUND OF THE INVENTION

Wire rope slings made of a plurality of metal strands twisted together and secured by large metal sleeves or collars are common in the industry. During the past thirty years, industrial metal slings have seen improvements in flexibility and strength. However, compared to non-metal or synthetic fiber slings, metal slings are relatively stiff and inflexible.

Synthetic fiber slings have gained popularity over the last fifteen years and are replacing metal slings in many circumstances. Synthetic slings are usually comprised of a core made of twisted strands of synthetic fiber and an outer cover that protects the core from physical damage. One of the more popular designs of synthetic slings is a roundsling in which the core forms a continuous loop and the sling has a circular or oval-shaped appearance. These synthetic slings have a very high strength-to-weight ratio which provides for lighter, more flexible and even stronger slings than their heavier and bulkier metal counterparts.

As thousands of roundslings are being used on a daily basis in a broad variety of heavy load lifting applications and safety applications, the slings are subjected to harsh environmental conditions in which the slings are subjected to extreme temperature and moisture conditions. In such conditions, the synthetic slings can absorb water or other liquids, making the saturated slings much heavier for an operator to effectively lift and maneuver. In addition, saturated slings exposed to cold temperatures can freeze, thereby eliminating the flexibility of the slings.

Therefore, there exists the need to provide a synthetic sling which can be effectively used in all conditions. It would, therefore, be beneficial to provide a synthetic sling which maintains its lightweight and flexible characteristics in harsh environments in which the sling is exposed to extreme moisture conditions.

SUMMARY OF THE INVENTION

One aspect of the disclosure is directed to a synthetic sling which has an endless load-bearing core with a plurality of loops of synthetic fibers. A tubular cover is provided for loosely containing the load-bearing core so that the fibers in the core are movable relative to each other and to the cover. The cover is waterproof to prevent the core from absorbing liquid. Due to the configuration of the cover, the core is prevented from increasing in weight and decreasing in flexibility due to liquid being absorbed by the core. The use of a waterproof cover insures that the roundsling will stay light and flexible even in harsh environmental conditions in which the sling is exposed to extreme moisture conditions.

Another aspect of the disclosure is directed to a synthetic sling which has an endless load-bearing core with a plurality of loops of synthetic fibers. A tubular cover is provided for loosely containing the load-bearing core so that the fibers in the core are movable relative to each other and to the cover. The cover is constructed to prevent the core from absorbing chemical liquids. This insures that the load-bearing core will not be exposed to non-compatible chemicals. The use of the cover also improves the rinsing characteristics of the sling, as the amount of water or rinsing or buffering liquids that are required to remove the chemical liquids from the sling is reduced, thereby reducing the drying time of the sling.

Another aspect of the disclosure is directed to a synthetic sling for use in harsh environments. The sling has a load-bearing core with a plurality of loops of synthetic fibers. A cover is provided for containing the load-bearing core loosely so that the fibers in the core are movable relative to each other and to the cover. The cover has a first end and a second end, with the second end extending over the first end and forming a seal therewith to enclose the core within the cover. The cover and the seal form a waterproof barrier which prevents the core from absorbing liquid and thereby prevents the core from increasing in weight and decreasing in flexibility due to such liquid absorption. This insures that the sling will stay light and flexible even in harsh environmental conditions.

Another aspect of the disclosure is directed to a synthetic sling which has two covers for use in harsh environments. The sling has a load-bearing core with a plurality of loops of synthetic fibers. An inner cover is provided for containing the load-bearing core loosely so that the fibers in the core are movable relative to each other and to the inner cover. The inner cover has a first end and a second end; the second end extends over the first end and forms a seal therewith to enclose the core within the inner cover. An outer cover is positioned over the inner cover. The outer cover is larger than the core and the inner cover and is generally spaced from the inner cover. The outer cover can move with respect to the inner cover. The outer cover protects the core from physical damage, and the inner cover and the seal form a barrier which prevents the core from absorbing liquid and thereby prevents the core from increasing in weight and decreasing in flexibility due to such liquid absorption. This insures that the sling will stay light and flexible even in harsh environmental conditions.

Another aspect of the disclosure is directed to a synthetic sling in which the function of the two covers is reversed. The sling has a load-bearing core with a plurality of loops of synthetic fibers. An inner cover is provided for containing the load-bearing core loosely so that the fibers in the core are movable relative to each other and to the inner cover. The inner cover protects the core from physical damage. An outer cover is positioned over the inner cover. The outer cover is larger than the core and the inner cover and is generally spaced from the inner cover. The outer cover can move with respect to the inner cover. The outer cover has a first end and a second end; the second end extends over the first end and forms a seal therewith to enclose the core and the inner cover within the outer cover. The outer cover and the seal form a barrier which prevents the core and the inner cover from absorbing liquid and thereby prevents the core and the inner cover from increasing in weight and decreasing in flexibility due to such liquid absorption. This insures that the sling will stay light and flexible even in harsh environmental conditions.

Other features and advantages will be apparent from the following more detailed description of the preferred embodiment, taken in conjunction with the accompanying drawings which illustrate, by way of example, the principles of the invention.

DETAILED DESCRIPTION OF THE INVENTION

In describing the representative embodiments, specific terminology will be selected for the sake of clarity. However, the invention is not intended to be limited to the specific terms so selected, and it is to be understood that each specific term includes all technical equivalents that operate in a similar manner to accomplish a similar purpose.

Figure 1:
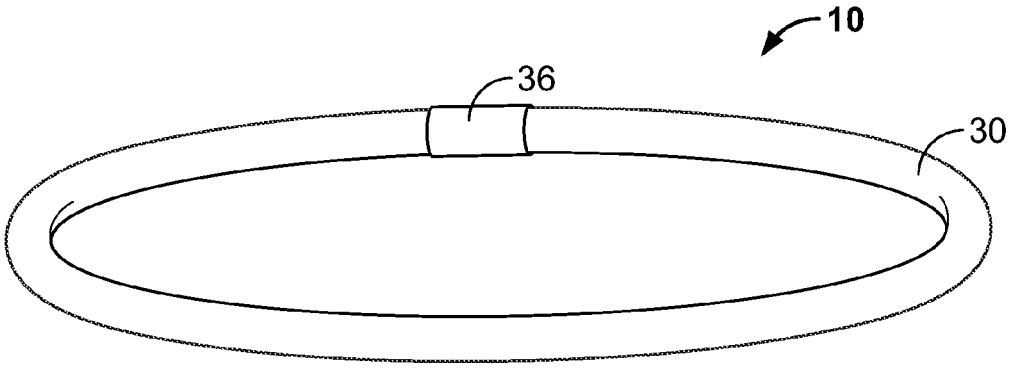
FIG. 1 is a perspective view of a single-walled roundsling in accordance with the present embodiment.

FIG. 1 illustrates a perspective view of a roundsling 10 in accordance with the present disclosure, however other types of slings may be substituted for the roundsling shown. FIG. 1 specifically shows a single-path roundsling, but the principles disclosed herein may be applied to other slings, whether single or multiple-path, which have a cover or sleeve which surrounds the core. Generally, such slings are constructed to have a high lifting and break strength, lighter weight, high temperature resistance and high durability, compared to wire rope or metal chain slings.

Figure 2:
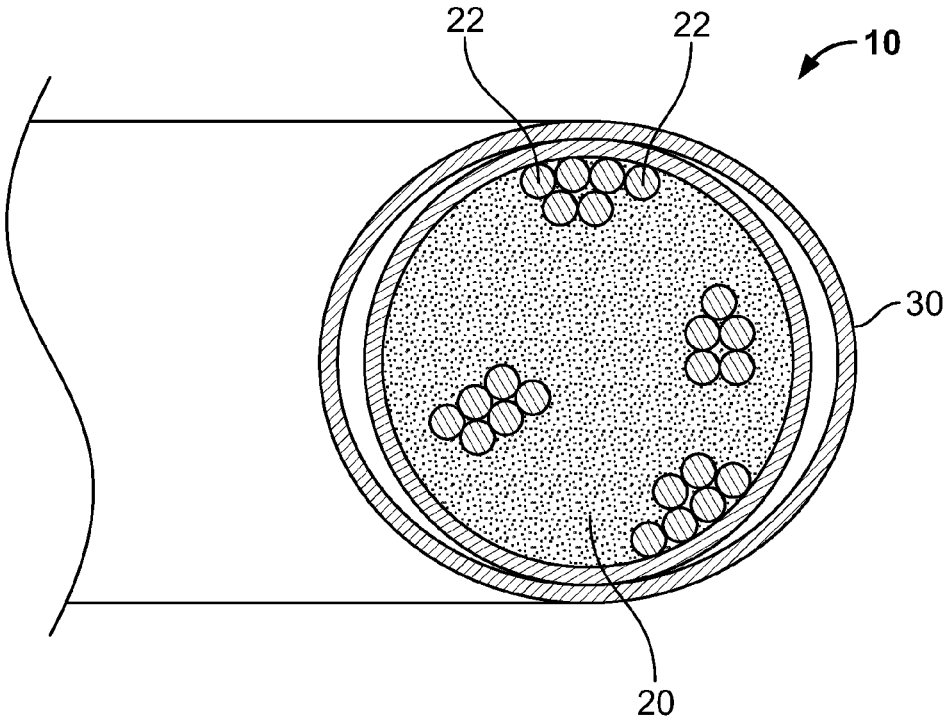
FIG. 2 is an enlarged cross-sectional view of the roundsling illustrated in FIG. 1 taken along line 2-2.

As best shown in FIG. 2, the roundsling 10 comprises an inner core 20 encased within a protective tubular cover 30. The inner core 20 is designed to bear the entire weight of the load to be lifted, secured or absorbed. The cover 30, shown in FIG. 2, is larger than the load-bearing core 20 and is maintained in close proximity to the load-bearing core 20. Alternatively, the cover 30 may be configured to be spaced from the core. In either configuration, the cover 30 can move relatively freely with respect to the load-bearing core 20. The cover 30 may have various different configurations without departing from the scope of the invention. Regardless of the particular configuration of the cover 30, the cover 30 is configured to allow strands 22 of the core 20 to move relative to each other and relative to the cover 30.

The core 20 is preferably made of a single or multiple fibers or strands 22 configured in a plurality of endless parallel loops of strands to form a single core or multiple cores, all of which are contained inside the protective cover 30. The use of a single strand or multiple strands in this configuration is typical in the construction of roundslings.

The core 20 of the roundslings 10 may be derived from one or more natural or synthetic materials, such as polyester, polyethylene, polypropylene, nylon, HMPE, LCP, para-aramid or other types of synthetics. The material chosen for the core 20 primarily depends on the maximum weight the sling is designed to lift or the maximum force the sling is designed to withstand and the environment in which the sling 10 will be used.

The jacket, sleeve or cover 30 is applied to the core 20 using any known method. The cover 30 generally carries no load. The cover 30 may be have one or more layers and is formed from flexible polyester, nylon woven fabric, extruded material, or other yarn/fiber material which exhibits high tenacity or high abrasion characteristics, or high modulus to improve durability, abrasion and/or cut resistance, such as, but not limited to, ultra high molecular weight polyethylene (UHMWPE), aramid, and liquid crystal polymers, or other materials having similar characteristics. The cover 30 may be made in a seamless manner or may be formed by adjoining the long edges of an elongated strip of material to produce a watertight joint by known means, such as, but not limited to, stitching, seaming, adhesive and the like. If the material used for the cover 30 is not waterproof, the cover may be impregnated with materials with water resistant characteristics, such as, but not limited to, vinyl, polyurethane, rubber, latex, polyethylene, polyolefin, other polymeric or elastomeric compounds or a combination thereof, in order to make the cover 30 water-resistant and/or waterproof.

The cover 30 is configured to be waterproof (which includes water-resistant), thereby preventing water or other liquid, including liquid chemicals, from penetrating the cover 30 and saturating the core 20. If the sling 10 is used around chemicals, the cover 30 prevents the core 20 from being exposed to non-compatible chemicals. The use of the cover also improves the rinsing characteristics of the sling, as the amount of water or rinsing or buffering liquids that are required to remove the chemical liquids form the sling is reduced, thereby reducing the drying time of the sling.

In addition, another purpose of the cover 30 is to prevent physical damage to the core 20 from abrasion, sharp edges on the load, etc. The cover 30 will also help to reduce damage to the sling when it is used in an environment that will subject it to harsh elements such as heat, ultraviolet light, corrosive chemicals, gaseous materials, or other environmental pollutants. Protecting the core 20 is important as the roundslings can be used for many applications relating, but not limited, to construction, plant and equipment operations, ship building, oil drilling and the like.

Figure 3:
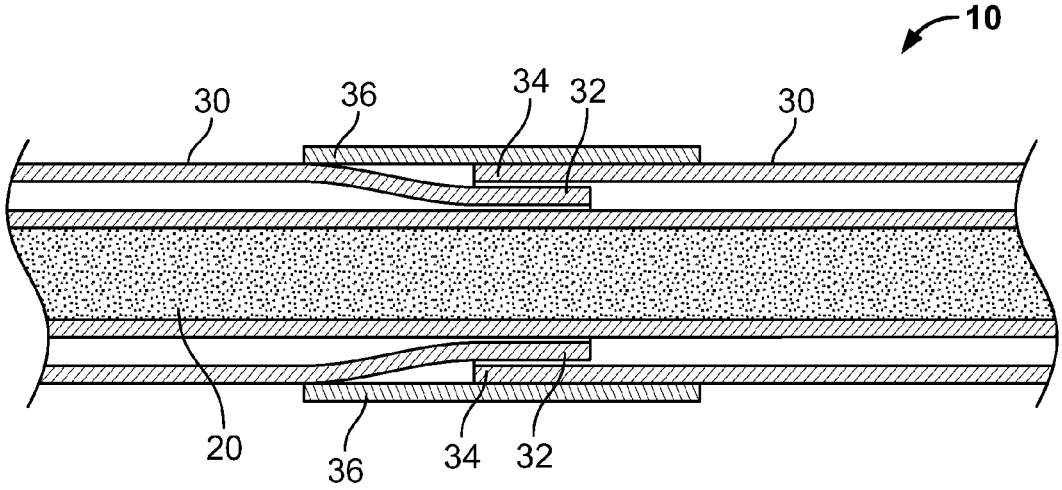
FIG. 3 is an enlarged perspective view of the seal provided on the roundsling illustrated in FIG. 1.

Referring to FIG. 3, the cover 30 has a first end 32 and a second end 34. The cover 30 is inserted onto the core 20 such that the second end 34 extends over the first end 32, thereby insuring that the entire core 20 is encased in the cover 30. The portion of the second end 34 that overlaps the portion of the first end 32 is sealed to the portion of the first end 32. A sleeve 36 which uses heat shrink technology can be used to create the seal. Alternatively, adhesives may be applied to perfect the seal. Other known methods, such as applying a single or double sided adhesive lined film or tubular film 35 between the overlapping portion of the first end 32 and the second end 34 (as shown in FIG. 4), can also be used in addition to or in lieu of the seal described with respect to FIG. 3 to seal the second end 34 to the first end 32.

Figure 4:
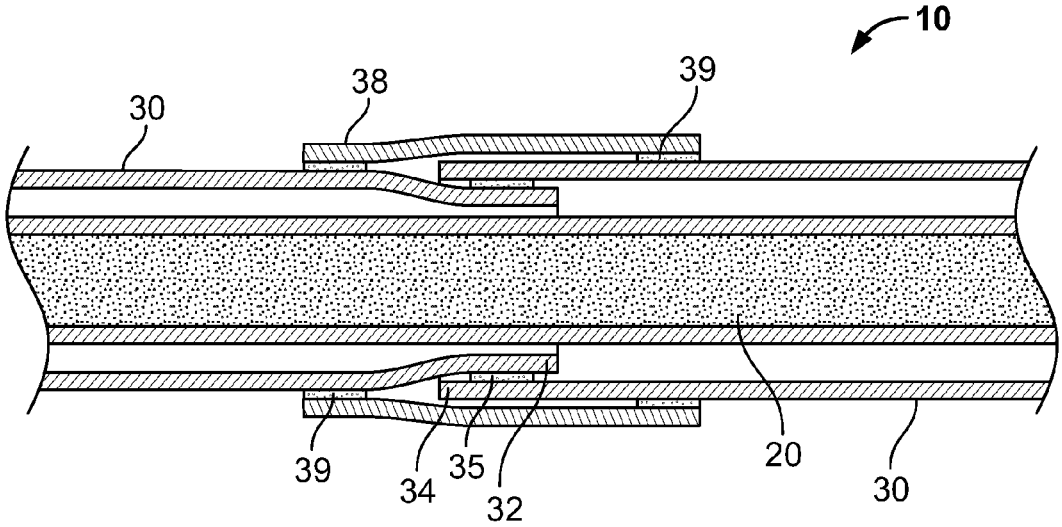
FIG. 4 is an enlarged perspective view of an alternate seal which may be used with the roundsling illustrated in FIG. 1.

Referring to FIG. 4, a flexible sealing member 38 may be applied over the second end 34 such that respective ends of the sealing member 38 are positioned on either side of the second end 34 of the cover 30. The flexible sealing member 38 may be made from elastomeric material or other materials having the flexibility and waterproof characteristics required. The sealing member 38 may be secured to the cover 30 using adhesive, tape 39 or other known materials applied proximate the ends of the sealing member 38. As the second end 34 is positioned between the sealed ends of the sealing member 38, the second end 34 and the cover 30 are sealed. The sealing member 38 can be used in combination with the sleeve 36 described above. No matter how the sealing is accomplished, the area of the seal must remain flexible, as the roundsling 10 must be able to be twisted along its entire length. Therefore, the seal must be able to accommodate twisting motion without failure.

Figure 5:
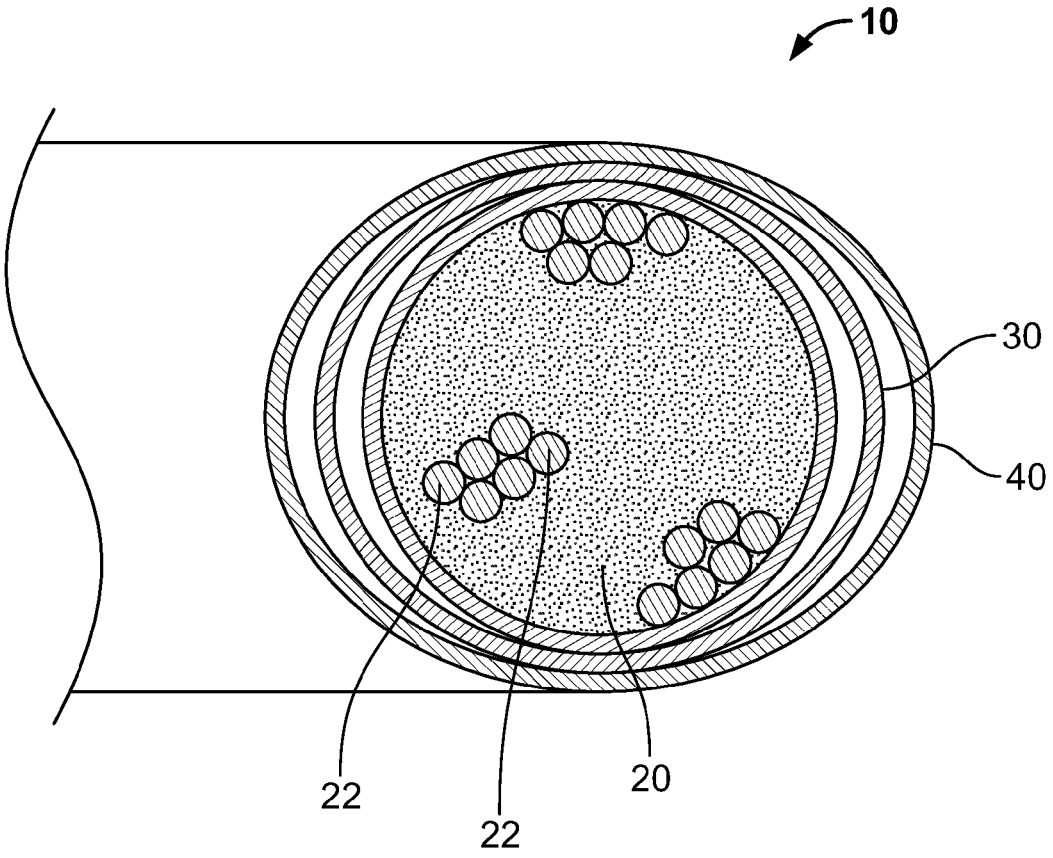
FIG. 5 is a perspective view of a double-walled roundsling in accordance with the present embodiment.

Referring to FIG. 5, an alternate embodiment is shown. In this embodiment, the roundsling 10 has the core 20, the sleeve or cover 30, and a tubular outer cover 40. The outer cover 40 is larger than the load-bearing core 20 and the cover 30 and is generally spaced from the cover 30, such that the outer cover 40 can move relatively freely with respect to the cover 30. The outer cover 40 may have one or more layer and may have various different configurations without departing from the scope of the invention.

The outer cover 40 is applied using any known method. The outer cover 40 generally carries no load and is formed from flexible polyester, nylon woven fabric, extruded material, or other yarn/fiber material which exhibits high tenacity or high abrasion characteristics, or high modulus to improve durability, abrasion and/or cut resistance, such as, but not limited to, ultra high molecular weight polyethylene (UHMWPE), aramid, and liquid crystal polymers, or other materials having similar characteristics. The outer cover 40 may be made in a seamless manner or may be formed by adjoining the long edges of an elongated strip of material to produce a watertight joint by known means, such as, but not limited to, stitching, seaming, adhesive and the like. If the material used for the outer cover 40 is not water-resistant, the cover may be impregnated with materials with water resistant characteristics, such as, but not limited to, vinyl, polyurethane, rubber, latex, polyethylene, polyolefin, other polymeric or elastomeric compounds or a combination thereof, in order to make the outer cover 40 water-resistant.

As this embodiment has a cover 30 and an outer cover 40, the functions of the covers can be divided. Generally, one purpose of the outer cover 40 is to prevent physical damage to the core 20 and the cover 30 from abrasion, sharp edges on the load, etc. Both cover 30 and outer cover 40 help to reduce damage to the core 20 when the sling 10 is used in an environment that will subject it to harsh elements such as heat, ultraviolet light, corrosive chemicals, gaseous materials, or other environmental pollutants. While outer cover 40 may be water-resistant, cover 30 is configured to be waterproof, thereby preventing water, chemicals or other liquid from penetrating the cover 30 and saturating the core 20. In the alternative, the functions of the cover 30 and outer cover 40 may be reversed, with the cover 30 configured to prevent physical damage to the core 20 and the outer cover 40 configured to be waterproof.

By having the cover 30 and outer cover 40 separated, each of the covers 30, 40 can be manufactured to have specific characteristics and perform different functions as described above. This allows each cover 30, 40 to be cost-effectively manufactured to perform the desired functions. This also provides better wear-resistance for extra sling life.

In all of the embodiments shown and described, one or both of the covers prevents water from permeating the core 20. While the introduction of water to the core 20 does not affect the strength of the core, the absorption of water in the core 20 causes the unwanted result of the core 20 and sling 10 becoming heavier due to the weight of the water absorbed. In various applications, the sling 10 must be handled and manipulated on site. In order for the sling 10 to be handled and manipulated properly, the weight and flexibility of the sling 10 must be maintained essentially the same as when the sling was new. Therefore, in harsh environments or in surroundings in which water is present, if the core 20 is allowed to become saturated, the weight of the sling 10 will increase significantly, making it difficult for a user/operator to transport or manipulate the sling 10. In addition, in environments where the sling 10 is exposed to extreme cold temperatures, any water absorbed into the core 20 will freeze, making it more difficult for the user/operator to manipulate the sling 10, as the sling 10 will become rigid due to the formation of ice, rather than flexible.

In addition, in environments in which the sling 10 is exposed and possibly submerged in chemicals, one or both of the covers prevent the core 20 from absorbing the chemical liquids. This insures that the load-bearing core 20 will not be exposed to non-compatible chemicals. The use of one or both of the covers also improves the rinsing characteristics of the sling 10, as the amount of water or rinsing or buffering liquids that are required to remove the chemical liquids form the sling 10 is reduced, thereby reducing the drying time of the sling 10.

As an example, in oil drilling applications, in which the sling 10 is used as a safety restraint to reduce the area of danger around high-pressure flow line disengagement, the user/operator must be able to move the sling 10 in position around the flow line. Once in position, the sling 10 must be secured to the flow line, by means of bending the sling 10, in order to be effective. Many of these drilling applications occur in areas such as the North Sea or other areas where water and frigid temperatures are common. If the core 20 of the sling 10 is allowed to absorb water, the sling 10 becomes essentially useless in this environment, as the sling 10 becomes extremely heavy from the water and stiff or rigid from the freezing of the water. It is, therefore, important for the cover 30 to be waterproof to prevent water from being introduced to the core 20 of the sling 10.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A synthetic roundsling comprising:

an endless load-bearing core having a plurality of loops of synthetic fibers in the sling core;

a tubular cover for containing the load-bearing core loosely so that the fibers in the core are movable relative to each other and to the cover, the cover being formed of at least one layer of non-woven, extruded, flexible waterproof/water resistant tubular material which loosely overlays the core to prevent the core from absorbing liquid, the cover having a first end and a second end which overlap;

a flexible sealing member provided over a second end of the cover such that respective ends of the sealing member are positioned on either side of the second end of the cover, the sealing member being formed of waterproof/water resistant material and being sealed to the cover which prevents the core from absorbing liquid;

whereby the core is prevented from increasing in weight and decreasing in flexibility due to liquid being absorbed by the core, thereby insuring that the roundsling will stay light and flexible even in harsh environmental conditions.

2. The synthetic roundsling as recited in claim 1, wherein the synthetic fibers of the core are formed of nylon, polyester, polyethylene, or polypropylene, or a combination of any of these.

3. The synthetic roundsling as recited in claim 1, wherein one or more layers of the cover is formed of an extruded tubular-shape of elastic material such as vinyl, polyethylene, nylon, polyester, or rubber, or a combination of any of these.

4. The synthetic roundsling as recited in claim 3, wherein one or more layers of the cover is impregnated with vinyl, polyurethane, rubber, latex, polyethylene, polyolefin, other polymeric compounds, elastomeric compounds, or a combination of any of these.

5. The synthetic roundsling as recited in claim 1, wherein the sealing member is made from elastomeric material.

6. The synthetic roundsling as recited in claim 1, wherein the flexible sealing member is formed from an elastomeric material.

7. The synthetic roundsling as recited in claim 1, wherein an outer cover is provided, the outer cover being larger than the core and the cover and being generally spaced from the cover, whereby the outer cover can move with respect to the cover, the outer cover being formed of nylon, polyester, extruded material, ultra high molecular weight polyethylene (UHMWPE), aramid, liquid crystal polymers, or a combination of any of these, and protecting the core from physical damage.

8. The synthetic roundsling as recited in claim 7, wherein the outer cover is formed in an extruded tubular-shape of vinyl, polyethylene, nylon, polyester, rubber, other polymeric compounds, other elastomeric compounds, or a combination of any of these.

9. A synthetic sling for use in harsh environments, the sling comprising:

a load-bearing core having a plurality of loops of synthetic fibers;

a cover for containing the load-bearing core loosely so that the fibers in the core are movable relative to each other and to the cover, the cover being formed of at least one layer of non-woven, extruded waterproof/water resistant material, the cover having a first end and a second end, the second end extending over the first end;

a flexible sealing member provided over the second end of the cover, respective ends of the sealing member are positioned on either side of the second end of the cover, the sealing member being formed of waterproof/water resistant material and being sealed to the cover, the cover and the sealing member cooperate to enclose the core within the cover;

whereby the cover and the sealing member prevent the core from absorbing liquid and prevent the core from increasing in weight and decreasing in flexibility due to liquid being absorbed by the core, thereby insuring that the sling will stay light and flexible even in harsh environmental conditions.

10. The synthetic sling as recited in claim 9, wherein one or more layers of the cover is formed of nylon, polyester, extruded material, ultra high molecular weight polyethylene (UHMWPE), aramid, liquid crystal polymers, or a combination of any of these.

11. The synthetic sling as recited in claim 9, wherein one or more layers of the cover is impregnated with vinyl, polyurethane, rubber, latex, polyethylene, polyolefin, other polymeric compounds, other elastomeric compounds, or a combination of any of these.

12. The synthetic sling as recited in claim 9, wherein an outer cover is provided, the outer cover being larger than the core and the cover and being generally spaced from the cover, whereby the outer cover can move with respect to the cover, the outer cover being formed of nylon, polyester, extruded material, ultra high molecular weight polyethylene (UHMWPE), aramid, liquid crystal polymers, or a combination of any of these, and protecting the core from physical damage.

13. The synthetic sling as recited in claim 12, wherein the outer cover is impregnated with vinyl, polyurethane, rubber, latex, polyethylene, polyolefin, other polymeric compounds, other elastomeric compounds, or a combination of any of these.

14. A synthetic sling for use in harsh environments, the sling comprising:

a load-bearing core having a plurality of loops of synthetic fibers;

an inner cover for containing the load-bearing core loosely so that the fibers in the core are movable relative to each other and to the inner cover, the inner cover being formed of at least one layer of non-woven, extruded waterproof/water resistant material, the inner cover having a first end and a second end, the second end extending over the first end, the inner cover having a flexible sealing member provided over the second end, respective ends of the sealing member are positioned on either side of the second end of the inner cover, the sealing member being formed of waterproof/water resistant material and being sealed to the inner cover, the inner cover and the sealing member cooperate to enclose the core within the inner cover;

an outer cover, the outer cover being larger than the core and the inner cover and being generally spaced from the inner cover, whereby the outer cover can move with respect to the inner cover;

whereby a combination of the inner and outer covers protect the core from physical damage and prevent the core from absorbing liquid and from increasing in weight and decreasing in flexibility due to liquid being absorbed by the core, thereby insuring that the sling will stay light and flexible even in harsh environmental conditions.

15. The synthetic sling as recited in claim 14, wherein the inner cover is formed of material which exhibits high tenacity, high abrasion, high modulus or a combination of any of these to improve durability, abrasion and cut resistance of the inner cover.

16. The synthetic sling as recited in claim 14, wherein the outer cover is formed of material which exhibits high tenacity, high abrasion, high modulus or a combination of any of these to improve durability, abrasion and cut resistance of the outer cover.

17. The synthetic sling as recited in claim 14, wherein the outer cover is impregnated with materials with water resistant characteristics.

* * * * *